US006040122A

United States Patent [19]

Fogel et al.

[11] Patent Number: 6,040,122

[45] Date of Patent: Mar. 21, 2000

[54] BLEACHING BATH

[75] Inventors: Thomas Fogel, Strassenhaus; Jürgen Göhmann, Monheim; Norman Klaunzer, Leverkusen, all of Germany

[73] Assignee: Agfa Gevaert NV, Belgium

[21] Appl. No.: 09/318,514

[22] Filed: May 25, 1999

[30] Foreign Application Priority Data

Jun. 5, 1998 [DE] Germany ..... 198 25 180

[51] Int. Cl.[7] ..... G03C 7/42

[52] U.S. Cl. ..... 430/461; 430/393; 430/430; 430/943

[58] Field of Search ..... 430/461, 943

[56] References Cited

U.S. PATENT DOCUMENTS 4,301,236 11/1981 Idota et al. ..... 430/393

5,006,456 4/1991 Morigaki et al. ..... 430/461

FOREIGN PATENT DOCUMENTS 678 783 10/1995 European Pat. Off. .

679 945 11/1995 European Pat. Off. .

*Primary Examiner*—Hoa Van Le

*Attorney, Agent, or Firm*—Connolly, Bove, Lodge & Hutz LLP

[57] ABSTRACT

A bleaching bath for processing photographic silver halide materials with hydrogen peroxide as the active substance, characterised in that it contains at least one organic compound having a sulfinic acid function and a further functional group with free electron pairs, is distinguished by improved bleaching action and makes it possible to achieve continuous processing of hard to bleach photographic materials having an elevated silver content.

12 Claims, No Drawings

BLEACHING BATH

This invention relates to a bleaching bath for photographic silver halide materials and to a process for processing these materials.

When processing photographic silver halide materials, it is necessary to bleach the silver produced on development, i.e. to oxidise it to silver ions, which, together with unexposed silver halide, are dissolved out of the material (fixing stage) by means of a silver halide solvent, for example a thiosulfate.

Good bleaches should have the following characteristics:

1. They should rapidly and completely bleach the exposed and developed material.
2. They should not cause any fogging in the photographic material.
3. They should result in quantitative formation of the dyes.
4. They should be biodegradable.
5. They should not dissolve silver ions to form complexes.
6. They should preferably have an adequate bleaching action even in the absence of ammonium ions.

Iron(III) complex compounds of aminopolycarboxylic acids are conventionally used as bleaches, for example complex compounds of ethylenediaminetetraacetic acid (EDTA), propylenediaminetetraacetic acid (PDTA), diethylenetriaminepentaacetic acid (DTPA) or nitrilodiacetic-monopropionic acid (ADA). None of these substances fulfils all of the stated requirements.

Attempts have for some time already been made to achieve efficient bleaching of silver halide materials without costly and environmentally polluting heavy metal complexes.

Apart from peroxides, peroxyborates, peroxycarbonates and peroxycarboxylic acids, which, however, due to the low active peroxide content and the consequent elevated salt loading of the bleaching bath, bleach silver bromide materials in particular only poorly, peroxydisulfates have already been used as bleaches (U.S. Pat. Nos. 2,810,648, 5,460,924).

Bleaching baths with peroxydisulfate require kinetic activation by redox-active components, which, in order to ensure the stability of the bleaching bath, are usually located in a separate preliminary bath. Due to the elevated standard redox potential of peroxydisulfate ($E_0$=2.01 V), large quantities of halide are oxidised in any bleaching baths which contain peroxydisulfate. The chlorine or bromine arising in this manner is either liberated or forms organochlorine or organobromine compounds. In any case, this considerably complicates the handling of these baths.

Hydrogen peroxide is also successfully used as a bleach (EP-A-428 101, WO 92/07 300, WO 93/11 459, EP-A-729 065). A fresh $H_2O_2$ bleaching bath exhibits neither the kinetic inhibition of a peroxydisulfate bleaching bath, nor has the potential required for oxidising chloride or bromide. With photographic recording materials predominantly consisting of silver chloride and having a low silver content, known bleaching baths also initially provide an acceptable bleaching action. However, if a $H_2O_3$bleaching bath is contaminated with substances entrained from the developer bath or diffusing out of the material, some of the bleaching action is lost. Even an upstream stop bath cannot prevent this. One cause for this phenomenon is assumed to be kinetic inhibition of silver oxidation by substances adsorbed on the silver grain (*Research Disclosure* 116 (1973), EP-A-747 764).

The use of hydrogen peroxide as a bleach in combination with various compounds has already been described.

U.S. Pat. No. 4,301,236 discloses a bleaching bath which, in addition to hydrogen peroxide, contains a metal complex compound and an aromatic sulfonic acid. The sulfonic acid is intended to stabilise the hydrogen peroxide. No effect on the bleaching action is observed.

EP-A-678 783 and EP-A-679 945 describe bleaching baths which contain hydrogen peroxide and a sulfonic acid. Addition of the sulfonic acid is intended to prevent blistering on the photographic material during processing. An improvement in bleaching action is also reported.

The still poor bleaching action of prior art $H_2O_2$ bleaching baths in the in-service state and the inadequate bleaching of photographic materials predominantly consisting of silver bromide and having an elevated silver content have hitherto prevented these environmentally advantageous bleaching baths from being adopted in favour of bleaching baths containing large quantities of heavy metal complexes.

The object of the present invention was accordingly to provide an $H_2O_2$ bleaching bath having very good bleaching action which makes it possible to achieve continuous processing of even hard to bleach photographic materials having an elevated silver content.

It has been found that this object is achieved by the addition of a sulfinic acid derivative to the bleaching bath.

The present invention accordingly provides a bleaching bath for processing photographic silver halide materials having hydrogen peroxide as the active substance, characterised in that the bath contains at least one organic compound having a sulfinic acid function and a further functional group with free electron pairs.

Examples of particularly suitable functional groups are the carboxyl, carbonyl, alkoxycarbonyl, carboxamide, hydroxy, sulfonyl, sulfinyl and nitro group.

By the selection of the functional groups, the sulfinic acid derivatives according to the invention are capable of forming complex compounds with certain metal ions.

In a preferred embodiment of the invention, the sulfinic acid derivatives are of the formula I (I)

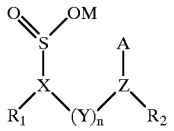

in which

X,Z mean carbon or nitrogen,

Y means carbon,

A means a carboxyl, carbonyl, alkoxycarbonyl, carboxamide, hydroxy, sulfonyl, sulfinyl or nitro group, M means hydrogen, alkali metal or alkaline earth metal or ammonium, n means 0 or 1 and $R_1$, $R_2$ mean hydrogen or alkyl and wherein $R_1$ and $R_2$ or $R_2$ and A may form a carbocyclic or heterocyclic ring.

The following meanings are preferred in the formula I:

X,Z carbon,

A a carboxyl or sulfonyl group,

M hydrogen and n 0.

In the formula I, $R_2$ and $R_2$ preferably form an aromatic ring having 5 or 6 ring atoms. If this ring is a heterocyclic ring, nitrogen and oxygen are preferred heteroatoms.

Examples of compounds according to the invention are stated below.

I-1

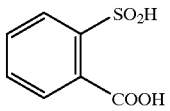

I-2

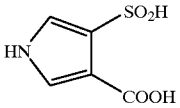

I-3

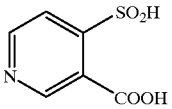

I-4

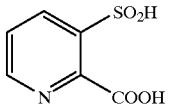

I-5

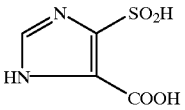

I-6

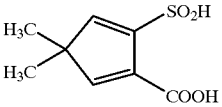

I-7

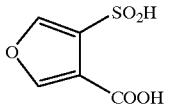

I-8

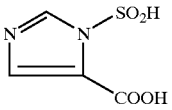

I-9

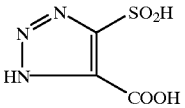

I-10

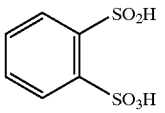

I-11

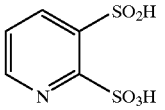

I-12

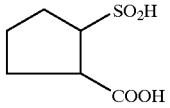

-continued

I-13

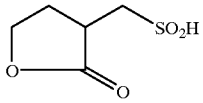

I-14

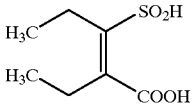

I-15

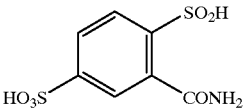

I-16

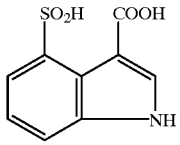

The sulfinic acid derivatives according to the invention may be produced in a similar manner to the method described in *J. Org. Chem.* Vol. 38 (1973) 4070 and in *Organomet. Chem. Rev.* Sect. A5 (1970) 281.

The sulfinic acid derivatives are conventionally used in the bleaching bath at a concentration of 1 to 1000 mmol/l. In a preferred embodiment, the bleaching bath contains the sulfinic acid derivatives in a quantity of 10 to 200 mmol/l.

In addition to the sulfinic acid derivatives and hydrogen peroxide, the bleaching bath according to the invention may also contain further auxiliary substances. These include, inter alia, rehalogenating agents, such as for example a soluble chloride, complexing agents, for example EDTA, and buffer substances, for example acetates or phosphates.

The bleaching bath preferably has a pH value of 4 to 8.

The present invention also provides a processing process for an exposed photographic silver halide material comprising at least the stages colour development, bleaching and fixing, characterised in that a bleaching bath according to the invention is used for bleaching.

An additional bath, preferably a rinsing bath or stop bath, may be included in the course of processing between the colour development and bleaching stages. In this embodiment of the invention, the organic compound having a sulfinic acid function and a further functional group with free electron pairs may be present either exclusively in this additional bath (variant 1) or both in this additional bath and in the bleaching bath (variant 2). In both variants, the preferred concentration of the organic sulfinic acid derivatives in this additional bath is 10 to 200 mmol/l.

The bleaching bath according to the invention is in particular suitable for processing colour photographic silver halide recording materials which contain on a reflective or transparent support (for example paper coated on both sides with polyethylene or cellulose triacetate film) at least one blue-sensitive, at least one green-sensitive and at least one red-sensitive silver halide emulsion layer, with which are associated in the stated sequence at least one yellow coupler, at least one magenta coupler and at least one cyan coupler.

Details of suitable silver halide emulsions, the production, ripening, stabilisation and spectral sensitisation thereof, including suitable spectral sensitisers, may be found in *Research Disclosure* 37254, part 3 (1995), p. 286, in

*Research Disclosure* 37038, part XV (1995), p.89 and in *Research Disclosure* 38957, part V.A (1996), p.603.

Photographic materials having camera sensitivity conventionally contain silver bromide-iodide emulsions, which may optionally contain small proportions of silver chloride. Photographic print materials contain either silver chloride-bromide emulsions containing up to 80 mol. % AgBr or silver chloride-bromide emulsions containing more than 95 mol. % AgCl.

The bleaching bath according to the invention is used within the conventional processing process for photographic silver halide materials. Details of procedures and chemicals required for this purpose are disclosed in Research Disclosure 37254, part 10 (1995), p. 294 and in *Research Disclosure* 37038, parts XVI to XXIII (1995), pp. 95 et seq. together with example materials.

The processing process may be performed continuously with constant replenishment of the individual processing baths.

EXAMPLE 1

(Processing of Colour Negative Paper)

A colour photographic recording material was produced by applying the following layers in the stated sequence onto a film support of paper coated on both sides with polyethylene. All quantities are stated per 1 $m^2$. The silver halide application rate is stated as the corresponding quantities of $AgNO_3$.

Layer 1: (Substrate layer)
- 0.10 g of gelatine

Layer 2: (Blue-sensitive layer)
Blue-sensitised silver halide emulsion (99.5 mol % chloride, 0.5 mol % bromide, average grain diameter 0.9 μm) prepared from 0.50 g of $AgNO_3$ with
- 0.70 mg of blue sensitiser BS-1
- 0.30 mg of stabiliser ST-1
- 1.25 g of gelatine
- 0.55 g of yellow coupler Y-1
- 0.10 g of image stabiliser BST-1
- 0.50 g of oil former OF-1

Layer 3: (Interlayer)

-continued

- 1.10 g of gelatine
- 0.60 g of DOP scavenger EF-1
- 0.06 g of DOP scavenger EF-2
- 0.12 g of tricresyl phosphate (TCP)

Layer 4: (Green-sensitive layer)
Green-sensitised silver halide emulsion (99.5 mol % chloride, 0.5 mol % bromide, average grain diameter 0.47 μm) prepared from 0.40 g of $AgNO_3$ with
- 0.70 mg of green stabiliser GS-1
- 0.50 mg of stabiliser ST-2
- 0.77 g of gelatine
- 0.41 g of magenta coupler M-1
- 0.06 g of image stabiliser BST-2
- 0.12 g of DOP scavenger EF-2
- 0.34 g of dibutyl phthalate (DBP)

Layer 5: (UV protective layer)
- 0.95 g of gelatine
- 0.50 g of UV absorber UV-1
- 0.03 g of DOP scavenger EF-1
- 0.03 g of DOP scavenger EF-2
- 0.15 g of oil former OF-2
- 0.15 g of TCP Layer 6: (Red-sensitive layer)
Red-sensitised silver halide emulsion (99.5 mol % chloride, 0.5 mol % bromide, average grain diameter 0.5 μm) prepared from 0.30 g of $AgNO_3$ with
- 0.03 mg of red sensitiser RS-1
- 0.60 mg of stabiliser ST-3
- 1.00 g of gelatine
- 0.46 g of cyan coupler C-1
- 0.46 g of TCP Layer 7: (UV protective layer)
- 0.30 g of gelatine
- 0.20 g of UV absorber UV-1
- 0.10 g of oil former OF-3

Layer 8: (Protective layer)
- 0.90 g of gelatine
- 0.05 g of optical brightener WT-1
- 0.07 g of mordant (polyvinylpyrrolidone)
- 1.20 mg of silicone oil
- 2.50 mg of spacers (polymethyl methacrylate, average particle size 0.8 μm)
- 0.30 g of hardener H-1

Compounds used in layer structure 1:

BS-1

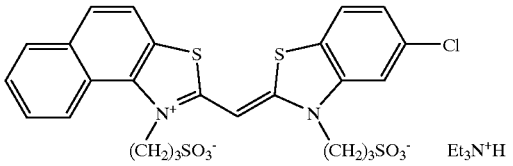

GS-1

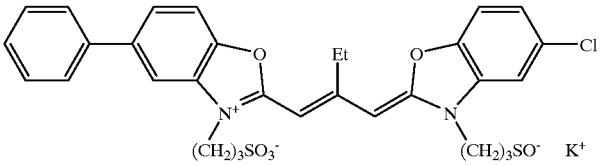

RS-1

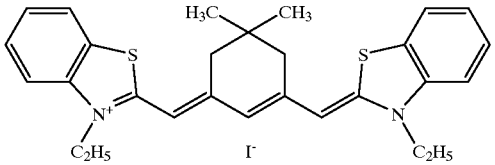

ST-1

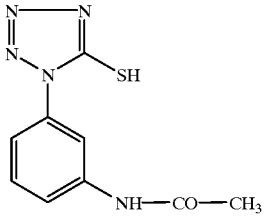

-continued
ST-2
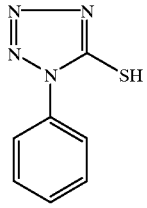
ST-3
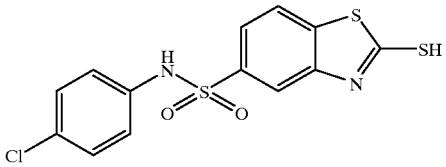
Y-1
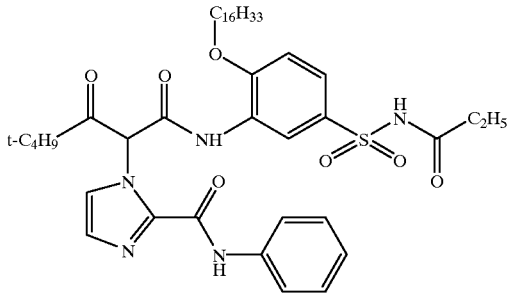
M-1
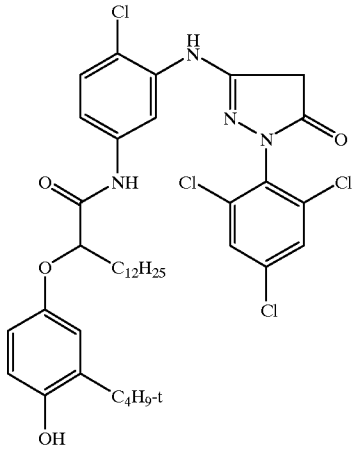
C-1
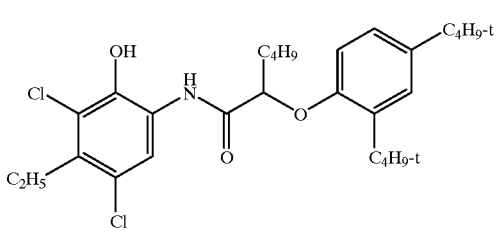
BST-1
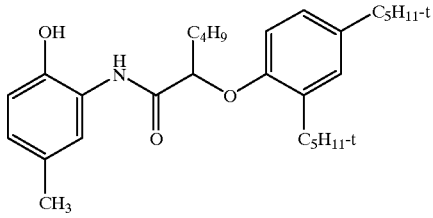
BST-2
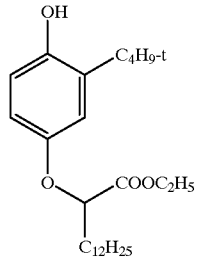
EF-1
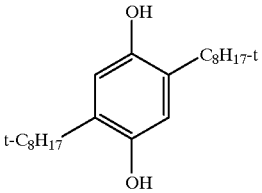
EF-2
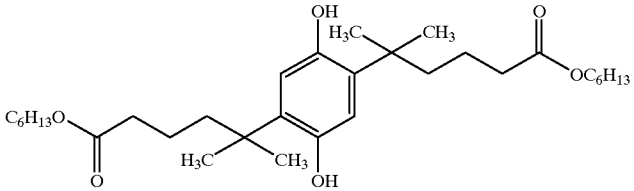
OF-1
Polyester prepared from HOOC—$(CH_2)_4$—COOH,
η (20° C.): 4000–5000 mPa·s
HO—$CH_2$—$C(CH_3)_2$—$CH_2$—OH and $C_{10}H_{21}$-i
$n_D$ (20° C.): 1.464–1.467
OF-2
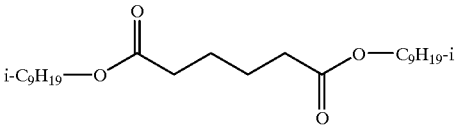

-continued

OF-3

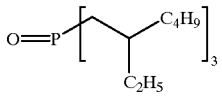

UV-1

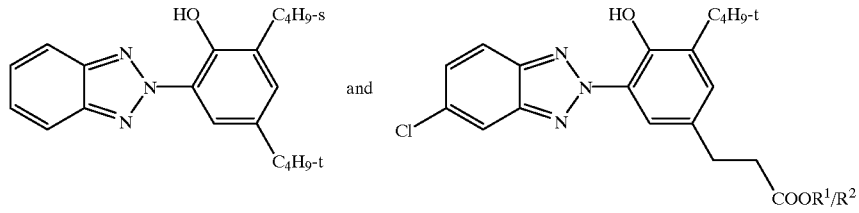

$R^1$ = —$C_8H_{17}$ $R^2$ = —$CH_2$—CH($C_2H_5$)—$C_4H_9$ $R^1/R^2$ = 1:1 in a 90:10 weight ratio

WT-1

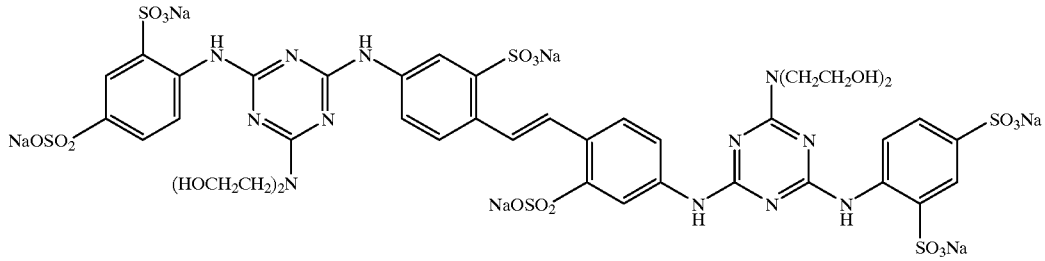

H-1

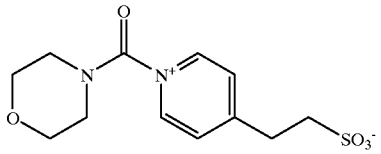

in a 90:10 weight ratio

The colour photographic material was dried, exposed with an image through a step wedge in a sensitometer and processed under the following conditions:

| Bath | Temperature | Time | Replenishment rate |
|---|---|---|---|
| Developer | 37° C. | 33 s | 60 ml/m$^2$ |
| Rinsing | 30° C. | 100 s | 300 ml/m$^2$ |
| Bleaching | 37° C. | 33 s | 200 ml/m$^2$ |
| Fixing | 37° C. | 33 s | 60 ml/m$^2$ |
| Stabilising | 37° C. | 60 s | 120 ml/m$^2$ |

The individual processing baths were of the following composition:

Colour developer bath (formulation for 1 liter)

| | |
|---|---|
| Water | 800 ml |
| Diethylenetriaminepentaacetic acid | 10 mmol |
| Hydroxyethanediphosphonic acid | 0.2 mmol |
| N,N-diethylhydroxylamine | 35 mmol |
| CD-3 | 13.7 mmol |
| Potassium chloride | 43 mmol |
| Potassium carbonate | 160 mmol |
| Optical brightener (4,4'-diaminostilbenesulfonic acid derivative) | 1 mmol |
| pH value | 10.3 |

-continued

Bleaching bath (formulation for 1 liter)

| | |
|---|---|
| Water | 800 ml |
| Diethylenetriaminepentaacetic acid | 1 mmol |
| Hydroxyethanediphosphonic acid | 0.1 mmol |
| Sodium dihydrogen phosphate | 30 mmol |
| Sodium chloride | 15 mmol |
| Hydrogen peroxide | 300 mmol |
| Sulfinic acid derivative | See table 1 |
| pH value | See table 1 |

Fixing bath (formulation for 1 liter)

| | |
|---|---|
| Water | 800 ml |
| Ammonium thiosulfate | 250 mmol |
| Sodium sulfite | 200 mmol |
| Sodium hydrogen carbonate | 400 mmol |
| Ethylenediaminetetraacetic acid | 1.5 mmol |
| pH value | 7 |

Stabilising bath (formulation for 1 liter)

| | |
|---|---|
| Water | 800 ml |
| Hydroxyethanediphosphonic acid | 0.2 mmol |
| Sodium benzoate | 5 mmol |
| Acetic acid | 150 mmol |
| Ethylenediaminetetraacetic acid | 2 mmol |
| pH value | 5 |

After processing, the residual silver content of the photographic material at maximum optical density was determined by X-ray fluorescence measurement.

Table 1 shows the influence of adding 10 mmol. of a compound according to the invention to the bleaching bath. It is evident that good bleaching is achieved by the addition of compounds I-1 to I-4, even once the in-service state (equilibrium) has been reached.

TABLE 1

| Bleaching bath | | | Residual | |
|---|---|---|---|---|
| Added substance | pH value | Status | silver [mg/m$^2$] | Comparison/ Invention |
| — | 4 | Fresh | <20 | Comparison |
| — | 4 | Equilibrium | 160 | Comparison |
| — | 8 | Fresh | <20 | Comparison |
| — | 8 | Equilibrium | 180 | Comparison |
| A | 4 | Equilibrium | 170 | Comparison |
| A | 8 | Equilibrium | 150 | Comparison |
| B | 4 | Equilibrium | 180 | Comparison |
| B | 8 | Equilibrium | 160 | Comparison |
| I-1 | 4 | Equilibrium | <20 | Invention |
| I-1 | 8 | Equilibrium | <20 | Invention |
| I-2 | 4 | Equilibrium | <20 | Invention |
| I-2 | 8 | Equilibrium | <20 | Invention |
| I-3 | 4 | Equilibrium | <20 | Invention |
| I-3 | 8 | Equilibrium | <20 | Invention |
| I-4 | 4 | Equilibrium | <20 | Invention |
| I-4 | 8 | Equilibrium | <20 | Invention |

A: o-carboxybenzenesulfonic acid
B: benzenesulfinic acid

EXAMPLE 2

(Processing of Colour Negative Paper)

The colour photographic recording material from Example 1 was dried, exposed with an image through a step wedge in a sensitometer and processed under the following conditions:

| Bath | Temperature | Time | Replenishment rate |
|---|---|---|---|
| Developer | 37° C. | 33 s | 60 ml/m$^2$ |
| Stop | 35° C. | 100 s | 340 ml/m$^2$ |
| Bleaching | 37° C. | 33 s | 200 ml/m$^2$ |
| Fixing | 37° C. | 33 s | 60 ml/m$^2$ |
| Stabilising | 37° C. | 60 s | 120 ml/m$^2$ |

The colour developer bath, bleaching bath, fixing bath and stabilising bath from Example 1 were used for processing. The stop bath was of the following composition:

| Stop bath (formulation for 1 liter) | |
|---|---|
| Water | 800 ml |
| Hydroxyethanediphosphonic acid | 0.2 mmol |
| Acetic acid | 200 mmol |
| Ethylenediaminetetraacetic acid | 2 mmol |
| Sulfinic acid derivative | See table 2 |
| pH value | 4 |

After processing, the residual silver content of the photographic material at maximum optical density was determined by X-ray fluorescence measurement. Table 2 shows the influence of adding 10 mmol. of a compound according to the invention to the stop bath. It is evident that good bleaching is achieved by the addition of compounds I-2 to I-5, even once the in-service state (equilibrium) has been reached.

TABLE 2

| Bleaching bath | | | Residual | |
|---|---|---|---|---|
| Stop bath Added substance | pH value | Status | silver [mg/m$^2$] | Comparison/ Invention |
| — | 4 | Fresh | <20 | Comparison |
| — | 4 | Equilibrium | 140 | Comparison |
| — | 8 | Fresh | <20 | Comparison |
| — | 8 | Equilibrium | 160 | Comparison |
| I-2 | 4 | Equilibrium | <20 | Invention |
| I-2 | 8 | Equilibrium | <20 | Invention |
| I-3 | 4 | Equilibrium | <20 | Invention |
| I-3 | 8 | Equilibrium | <20 | Invention |
| I-4 | 4 | Equilibrium | <20 | Invention |
| I-4 | 8 | Equilibnum | <20 | Invention |
| I-5 | 4 | Equilibrium | <20 | Invention |
| I-5 | 8 | Equilibrium | <20 | Invention |

EXAMPLE 3

(Processing Of Colour Negative Film)

The colour photographic recording material was produced by applying the following layers in the stated sequence onto a transparent cellulose triacetate film support. All quantities are stated per 1 m$^2$. The silver halide application rate is stated as the corresponding quantities of $AgNO_3$; the silver halides are stabilised with 0.5 g of 4-hydroxy-6-methyl-1,3,3a,7-tetraazaindene per mol. of $AgNO_3$.

| | | |
|---|---|---|
| 1$^{st}$ layer | (Anti-halo layer) | |
| | 0.3 g | of black colloidal silver |
| | 1.2 g | of gelatine |
| | 0.3 g | of UV absorber UV-1 |
| | 0.2 g | of DOP (developer oxidation product) scavenger SC-1 |
| | 0.02 g | of tricresyl phosphate (TCP) |
| 2$^{nd}$ layer | (Low sensitivity, red-sensitive layer) | |
| | 0.7 g | of $AgNO_3$ of a spectrally red-sensitised AgBrI emulsion, 4 mol % iodide, average grain diameter 0.42 $\mu$m |
| | 1 g | of gelatine |
| | 0.35 g | of colourless coupler C-1 |
| | 0.05 g | of coloured coupler RC-1 |
| | 0.03 g | of coloured coupler YC-1 |
| | 0.36 g | of TCP |
| 3$^{rd}$ layer | (Medium sensitivity, red-sensitive layer) | |
| | 0.8 g | of $AgNO_3$ of a spectrally red-sensitised AgBrI emulsion, 5 mol % iodide, average grain diameter 0.53 $\mu$m |
| | 0.6 g | of gelatine |
| | 0.15 g | of colourless coupler C-2 |
| | 0.03 g | of coloured coupler RC-1 |
| | 0.02 g | of DIR coupler D-1 |
| | 0.18 g | of TCP |
| 4$^{th}$ layer | (High sensitivity, red-sensitive layer) | |
| | 1 g | of $AgNO_3$ of a spectrally red-sensitised AgBrI emulsion, 6 mol % iodide, average grain diameter 0.85 $\mu$m |
| | 1 g | of gelatine |
| | 0.1 g | of colourless coupler C-2 |
| | 0.005 g | of DIR coupler D-2 |
| | 0.11 g | of TCP |
| 5$^{th}$ layer | (Interlayer) | |
| | 0.8 g | of gelatine |
| | 0.07 g | of DOP scavenger SC-2 |
| | 0.06 g | of aurintricarboxylic acid aluminium salt |
| 6$^{th}$ layer | (Low sensitivity, green-sensitive layer) | |
| | 0.7 g | of $AgNO_3$ of a spectrally green-sensitised AgBrI emulsion, 4 mol % iodide, average grain diameter 0.35 $\mu$m |
| | 0.8 g | of gelatine |
| | 0.22 g | of colourless coupler M-1 |
| | 0.065 g | of coloured coupler YM-l |

-continued

| | | |
|---|---|---|
| | 0.02 g | of DIR coupler D-3 |
| | 0.2 g | of TCP |
| 7th layer | (Medium sensitivity, green-sensitive layer) | |
| | 0.9 g | of $AgNO_3$ of a spectrally green-sensitised AgBrI emulsion, 4 mol % iodide, average grain diameter 0.50 μm |
| | 1 g | of gelatine |
| | 0.16 g | of colourless coupler M-1 |
| | 0.04 g | of coloured coupler YM-1 |
| | 0.015 g | of DIR coupler D-4 |
| | 0.14 g | of TCP |
| 8th layer | (High sensitivity, green-sensitive layer) | |
| | 0.6 g | of $AgNO_3$ of a spectrally green-sensitised AgBrI emulsion, 6 mol % iodide, average grain diameter 0.70 μm |
| | 1.1 g | of gelatine |
| | 0.05 g | of colourless coupler M-2 |
| | 0.01 g | of coloured coupler YM-2 |
| | 0.02 g | of DIR coupler D-5 |
| | 0.08 g | of TCP |
| 9th layer | (Yellow filter layer) | |
| | 0.09 g | of yellow dye GF-1 |
| | 1 g | of gelatine |
| | 0.08 g | of DOP scavenger SC-2 |
| | 0.26 g | of TCP |
| 10th layer | (Low sensitivity, blue-sensitive layer) | |
| | 0.3 g | of $AgNO_3$ of a spectrally blue-sensitised AgBrI emulsion, 6 mol % iodide, average grain diameter 0.44 μm |

-continued

| | | |
|---|---|---|
| | 0.5 g | of $AgNO_3$ of a spectrally blue-sensitised AgBrI emulsion, 6 mol % iodide, average grain diameter 0.50 μm |
| | 1.9 g | of gelatine |
| | 1.1 g | of colourless coupler Y-1 |
| | 0.037 g | of DIR coupler D-6 |
| | 0.6 g | of TCP |
| 11th layer | (High sensitivity, blue-sensitive layer) | |
| | 0.6 g | of $AgNO_3$ of a spectrally blue-sensitised AgBrI emulsion, 7 mol % iodide, average grain diameter 0.95 μm |
| | 1.2 g | of gelatine |
| | 0.1 g | of colourless coupler Y-1 |
| | 0.006 g | of DIR coupler D-7 |
| | 0.11 g | of TCP |
| 12th layer | (Micrate layer) | |
| | 0.1 g | of $AgNO_3$ of a micrate AgBrI emulsion, 0.5 mol % iodide, average grain diameter 0.06 μm |
| | 1 g | of gelatine |
| | 0.004 mg | of $K_2[PdCl_4]$ |
| | 0.4 g | of UV absorber UV-2 |
| | 0.3 g | of TCP |
| 13th layer | (Protective & hardening layer) | |
| | 0.25 g | of gelatine |
| | 0.75 g | of hardener H-1 |

Once hardened, the overall layer structure had a swelling factor of ≦3.5.

Substances used in Example 3:

UV-1

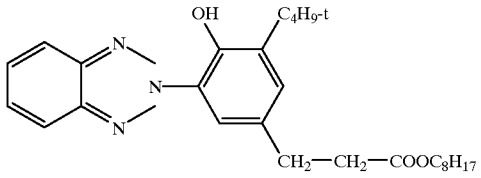

UV-2

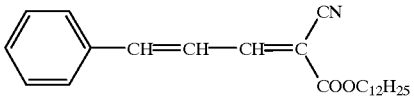

C-1

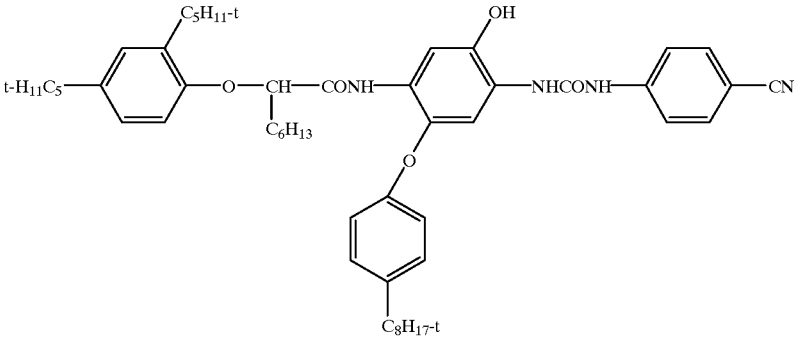

-continued
C-2
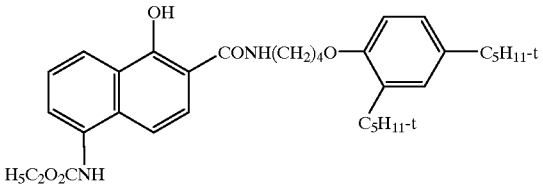
RC-1
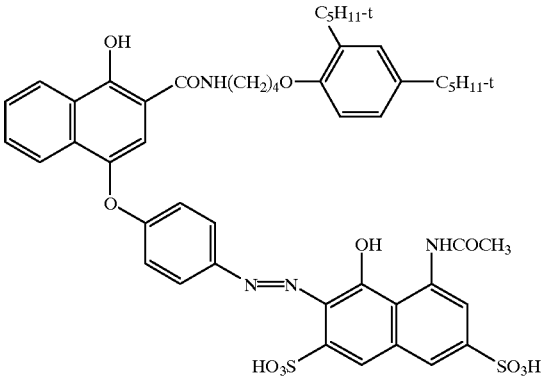
YC-1
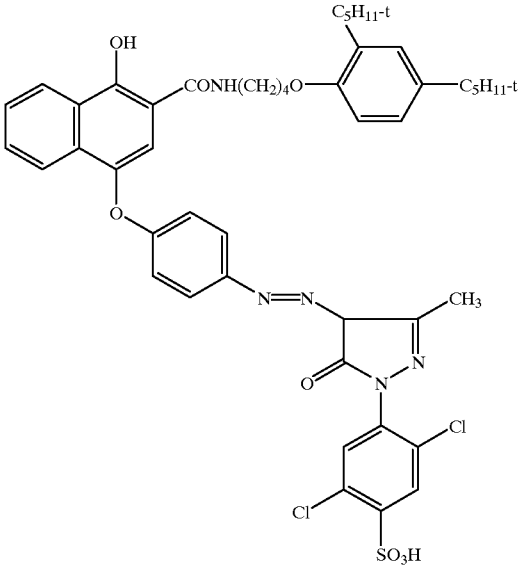
M-1
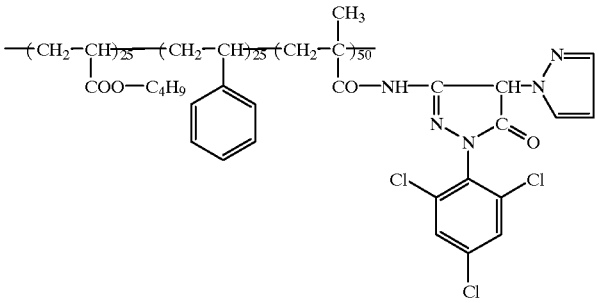
M-2
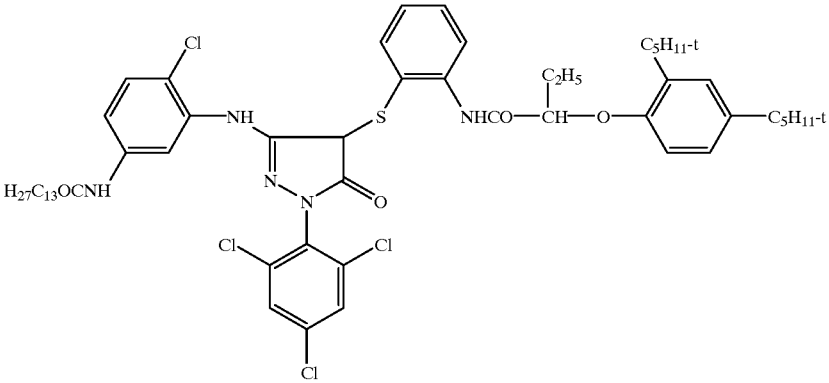

-continued
YM-1
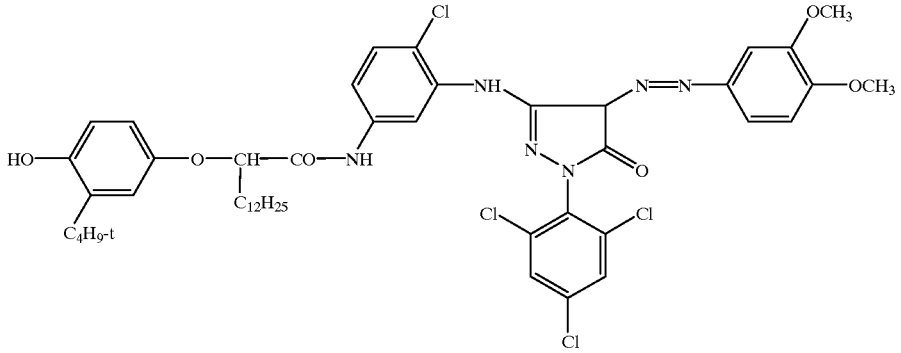
YM-2
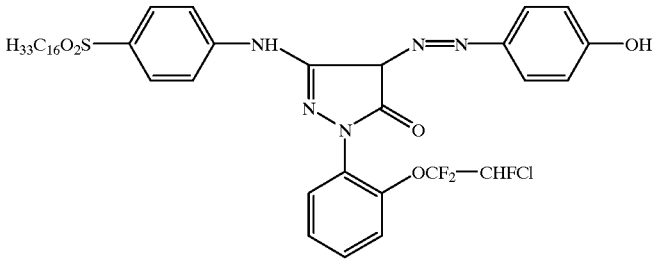
Y-1
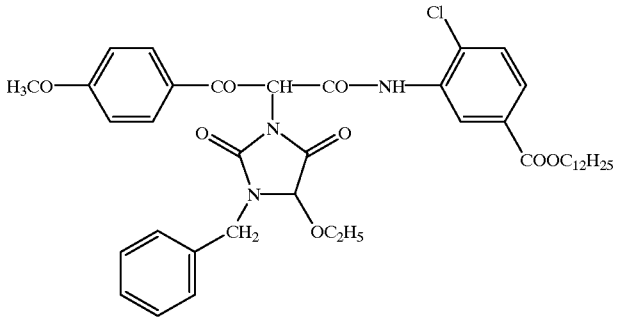
D-1
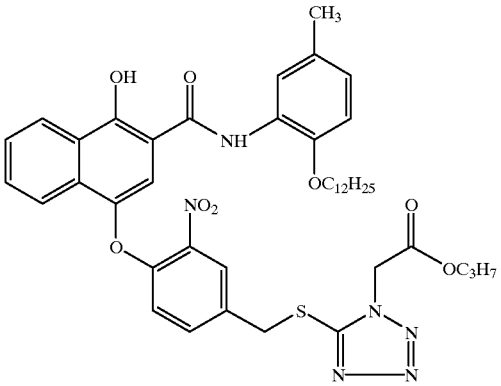
D-2
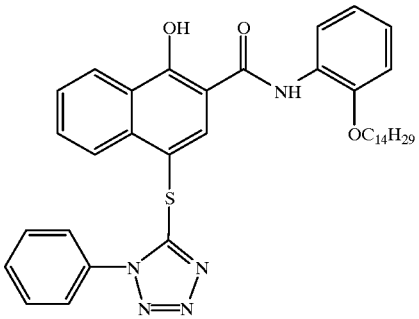

-continued
D-3
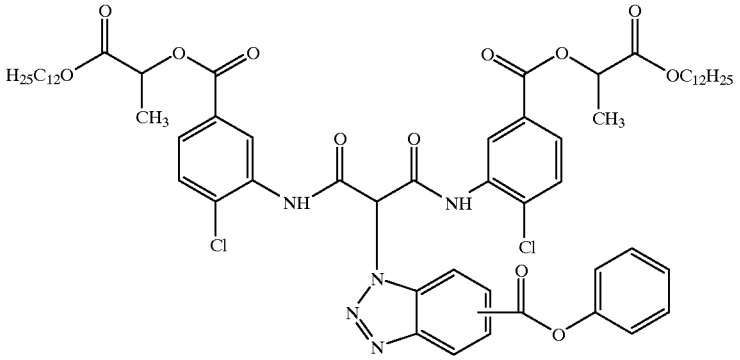
D-4
D-5
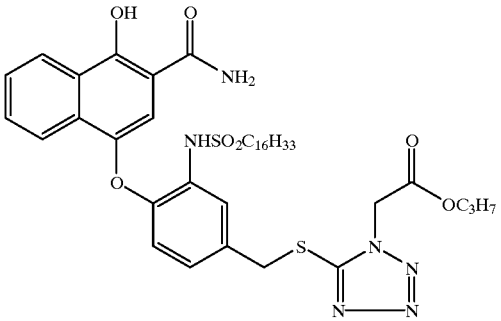
D-6
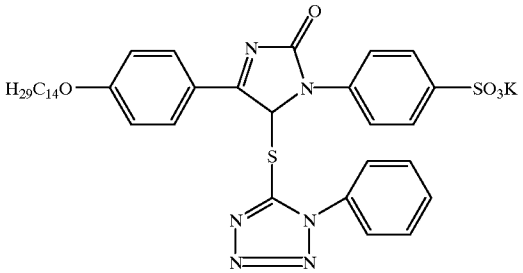
D-7
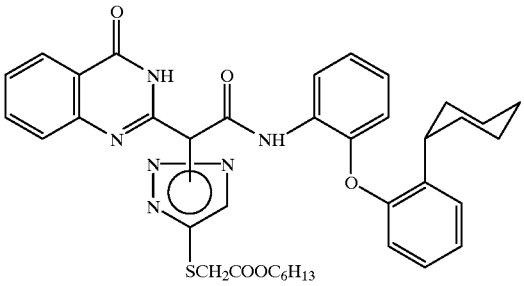
SC-1
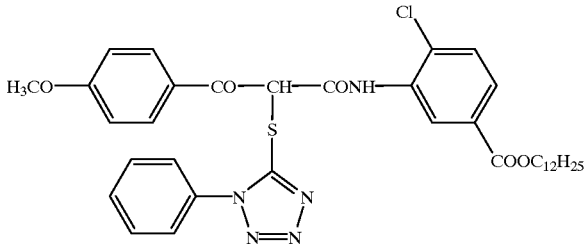
SC-2
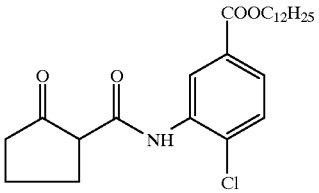
GF-1
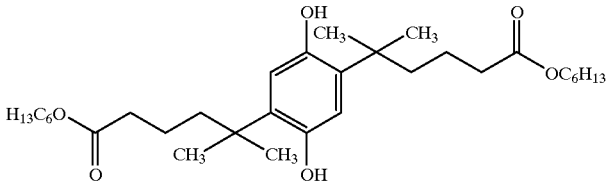
H-1
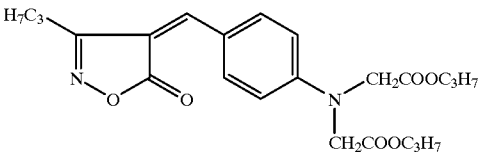
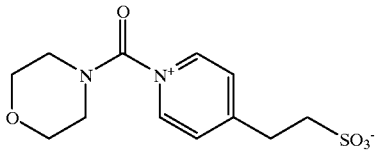
The colour photographic material was dried, exposed with an image through a step wedge in a sensitometer and processed under the following conditions:

| Bath | Temperature | Time | Replenishment rate |
|---|---|---|---|
| Developer | 37.8° C. | 195 s | 590 ml/m$^2$ |
| Rinsing (pH 4) | 35.0° C. | 180 s | 800 ml/m$^2$ |
| Bleaching | 35.0° C. | 195 s | 400 ml/m$^2$ |
| Fixing | 35.0° C. | 90 s | 400 ml/m$^2$ |
| Stabilising | 35.0° C. | 60 s | 1050 ml/m$^2$ |

The individual processing baths were of the following composition:

| Colour developer bath (formulation for 1 liter) | |
|---|---|
| Water | 800 ml |
| Diethylenetriaminepentaacetic acid | 1 mmol |
| Hydroxyethanediphosphonic acid | 0.2 mmol |
| Potassium carbonate | 170 mmol |
| Sodium sulfite | 34 mmol |
| Potassium iodide | $7.2 \times 10^{-3}$ mmol |
| Sodium bromide | 13 mmol |
| Hydroxylamine sulfate | 14 mmol |
| CD-4 | 15 mmol |
| pH value | 10.3 |
| **Bleaching bath (formulation for 1 liter)** | |
| Water | 800 ml |
| Diethylenetriaminepentaacetic acid | 10 mmol |
| Hydroxyethanediphosphonic acid | 0.1 mmol |
| Sodium dihydrogen phosphate | 30 mmol |
| Sodium chloride | 35 mmol |
| Hydrogen peroxide | 700 mmol |
| Sulfinic acid derivative | See table 3 |
| pH value | See table 3 |
| **Fixing bath (formulation for 1 liter)** | |
| Water | 800 ml |
| Ammonium thiosulfate | 500 mmol |
| Ammonium thiocyanate | 500 mmol |
| Sodium sulfite | 400 mmol |
| Sodium hydrogen carbonate | 400 mmol |
| Ethylenediaminetetraacetic acid | 2 mmol |
| pH value | 7.5 |
| **Stabilising bath (formulation for 1 liter)** | |
| Water | 800 ml |
| Hydroxyethanediphosphonic acid | 0.2 mmol |
| Polyoxyethylene p-nonylphenyl ether | 0.05 mmol |
| pH value | 5 |

After processing, the residual silver content of the photographic material at maximum optical density was determined by X-ray fluorescence measurement.

Table 3 shows the influence of adding 10 mmol. of a compound according to the invention to the bleaching bath. It is evident that good bleaching is achieved by the addition of compounds I-1, I-3 and I-4, even once the in-service state (equilibrium) has been reached.

TABLE 3

| Bleaching bath | | | Residual | |
|---|---|---|---|---|
| Added substance | pH value | Status | silver [mg/m$^2$] | Comparison/ Invention |
| — | 4 | Fresh | <20 | Comparison |
| — | 4 | Equilibrium | 510 | Comparison |
| — | 8 | Fresh | <20 | Comparison |
| — | 8 | Equilibrium | 460 | Comparison |
| A | 4 | Equilibrium | 510 | Comparison |
| A | 8 | Equilibrium | 620 | Comparison |
| B | 4 | Equilibrium | 560 | Comparison |
| B | 8 | Equilibrium | 580 | Comparison |
| I-1 | 4 | Equilibrium | <20 | Invention |

TABLE 3-continued

| Bleaching bath | | | Residual | |
|---|---|---|---|---|
| Added substance | pH value | Status | silver [mg/m$^2$] | Comparison/ Invention |
| I-1 | 8 | Equilibrium | <20 | Invention |
| I-3 | 4 | Equilibrium | <20 | Invention |
| I-3 | 8 | Equilibrium | <20 | Invention |
| I-14 | 4 | Equilibrium | <20 | Invention |
| I-14 | 8 | Equilibrium | <20 | Invention |

A: o-carboxybenzenesulfonic acid
B: benzenesulfinic acid

EXAMPLE 4

(Processing of Colour Negative Film)

The colour photographic recording material from Example 3 was dried, exposed with an image through a step wedge in a sensitometer and processed under the following conditions:

| Bath | Temperature | Time | Replenishment rate |
|---|---|---|---|
| Developer | 37.8° C. | 195 s | 590 ml/m$^2$ |
| Stop | 35.0° C. | 180 s | 800 ml/m$^2$ |
| Bleaching | 35.0° C. | 195 s | 400 ml/m$^2$ |
| Fixing | 35.0° C. | 90 s | 400 ml/m$^2$ |
| Stabilising | 35.0° C. | 60 s | 1050 ml/m$^2$ |

The colour developer bath, bleaching bath, fixing bath and stabilising bath from Example 3 were used for processing. The stop bath was of the following composition:

| Stop bath (formulation for 1 liter) | |
|---|---|
| Water | 800 ml |
| Hydroxyethanediphosphonic acid | 0.2 mmol |
| Acetic acid | 200 mmol |
| Ethylenediaminetetraacetic acid | 2 mmol |
| Sulfinic acid derivative | See table 4 |
| pH value | 4 |

After processing, the residual silver content of the photographic material at maximum optical density was determined by X-ray fluorescence measurement. Table 4 shows the influence of adding 10 mmol. of a compound according to the invention to the stop bath. It is evident that good bleaching is achieved by the addition of compounds I-2, I-3 and I-4, even once the in-service state (equilibrium) has been reached.

TABLE 4

| | Bleaching bath | | Residual | |
|---|---|---|---|---|
| Stop bath Added substance | pH value | Status | silver [mg/m$^2$] | Comparison/ Invention |
| — | 4 | Fresh | <20 | Comparison |
| — | 4 | Equilibrium | 500 | Comparison |
| — | 8 | Fresh | <20 | Comparison |
| — | 8 | Equilibrium | 420 | Comparison |
| I-2 | 4 | Equilibrium | <20 | Invention |
| I-2 | 8 | Equilibrium | <20 | Invention |
| I-3 | 4 | Equilibrium | <20 | Invention |
| I-3 | 8 | Equilibrium | <20 | Invention |

TABLE 4-continued

| Stop bath Added substance | Bleaching bath pH value | Bleaching bath Status | Residual silver [mg/m$^2$] | Comparison/ Invention |
|---|---|---|---|---|
| I-14 | 4 | Equilibrium | <20 | Invention |
| I-14 | 8 | Equilibrium | <20 | Invention |

We claim:

1. Bleaching bath for processing photographic silver halide materials which comprises hydrogen peroxide as the active substance, wherein the bath contains at least one organic compound having a sulfinic acid function and a further functional group with free electron pairs.

2. Bleaching bath according to claim 1, wherein the organic compound is a sulfinic acid derivative of the formula I (I)

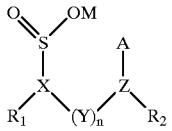

in which

X and Z are identical and different and are carbon or nitrogen,

Y means carbon

A means a carboxyl, carbonyl, alkoxycarbonyl, carboxamide, hydroxy, sulfonyl, sulfinyl or nitro group, M means hydrogen, alkali metal or alkaline earth metal or ammonium, n means 0 or 1 and $R_1$ and $R_2$ are identical and different and are hydrogen or alkyl or $R_1$ and $R_2$ or $R_2$ and A form a carbocyclic or heterocyclic ring.

3. Bleaching bath according to claim 2, wherein the organic compound is in a concentration of 10 to 200 mmol/l.

4. The bleaching bath according to claim 2, wherein X and Z are carbon, A is a carboxyl or sulfonyl group, M is hydrogen, and n is zero.

5. The bleaching bath according to claim 3 wherein X and Z are carbon, M is hydrogen, n is zero, $R_1$ and $R_2$ form an aromatic ring having 5 or 6 ring atoms which optionally includes nitrogen or oxygen heteroatoms.

6. The bleaching bath according to claim 5 wherein the sulfonic acid derivative of the formula (1) is selected from the group consisting of

I-1

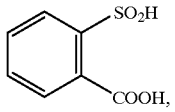

I-2

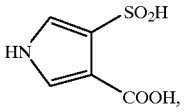

-continued

I-3

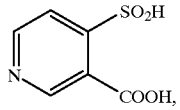

I-4

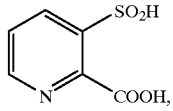

I-5

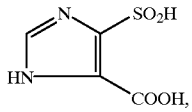

I-6

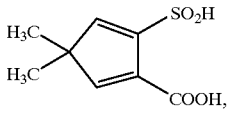

I-7

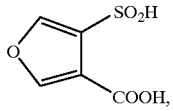

I-8

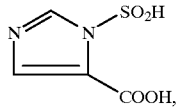

I-9

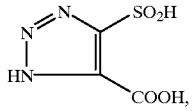

I-10

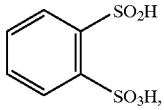

I-11

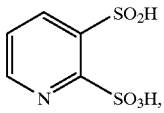

I-12

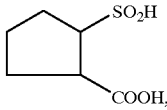

I-13

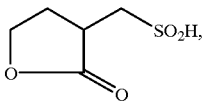

I-14

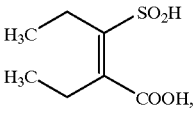

-continued

I-15

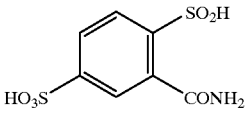

and

I-16

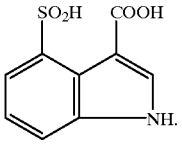

7. The bleaching bath according to claim 1, wherein the sulfinic acid derivative is at a concentration of 1 to 1000 mmol/l.

8. The bleaching bath according to claim 5, wherein the sulfinic acid derivative is at a concentration of 10 to 200 mmol/l and the bleaching bath has a pH value of 4 to 8.

9. Processing process for an exposed photographic silver halide material at least comprising the stages color development, bleaching and fixing, wherein said bleaching bath according to claim 1 is used for said bleaching.

10. Process according to claim 9 which further comprises an additional bath between the stages color development and bleaching, wherein said additional bath contains at least one organic compound having a sulfinic acid function and a further functional group with free electron pairs.

11. The process according claim 9, wherein said bleaching bath has a pH value of 4 to 8 and the sulfonic acid derivative is at a concentration of 1 to 1000 mmol/l.

12. The process as claimed in claim 4, wherein the photographic silver halide material contains a reflective or transparent support which has at least one blue sensitive silver halide emulsion, at least one green sensitive silver halide emulsion layer and at least one red sensitive silver halide emulsion layer, with which are associated in the stated sequence at least one yellow coupler, at least one magenta coupler and at least one cyan coupler.

* * * * *